US006637815B1

(12) United States Patent
Louque et al.

(10) Patent No.: US 6,637,815 B1
(45) Date of Patent: Oct. 28, 2003

(54) BOAT SEAT COVER

(76) Inventors: Gary J. Louque, 12359 Cleo Rd., Gonzales, LA (US) 70737; Linda Louque, 12359 Cleo Rd., Gonzales, LA (US) 70737

( * ) Notice: Subject to any disclaimer, the term of this patent is extended or adjusted under 35 U.S.C. 154(b) by 0 days.

(21) Appl. No.: 10/051,024

(22) Filed: Jan. 18, 2002

(51) Int. Cl.[7] ..... A47C 7/66

(52) U.S. Cl. ..... 297/184.11; 297/229; 114/361; 114/363

(58) Field of Search ..... 297/229, 184.11, 297/219.1, 228.1; 114/363, 361; 296/100.15, 100.16, 100.18

(56) References Cited

U.S. PATENT DOCUMENTS 1,985,222 A * 12/1934 Menhall ..... 297/223
4,118,066 A * 10/1978 Ricke ..... 297/184.11
4,320,922 A * 3/1982 Meritis ..... 297/220
4,600,238 A * 7/1986 Goodford ..... 297/219.1 X
4,790,592 A * 12/1988 Busso et al. ..... 297/184.11
5,102,190 A 4/1992 Akin et al.
5,240,020 A 8/1993 Byers
5,320,405 A 6/1994 Foster
5,330,251 A * 7/1994 McGuire ..... 297/229 X
5,380,059 A 1/1995 Felling
D367,788 S 3/1996 Lawhorn
5,638,849 A 6/1997 Scott
6,158,805 A * 12/2000 Blaney ..... 297/184.11 X

* cited by examiner

*Primary Examiner*—Anthony D. Barfield

(57) ABSTRACT

A boat seat cover for protecting the boat seat from the outside elements. The boat seat cover includes a container having a longitudinal opening being disposed through a side wall thereof; and also includes a spring-loaded spindle being rotatably disposed in the container; and further includes a cover member including a sheet of material being carried about and retractably extended from the spring-loaded spindle and also having an outer edge; and also includes a fastening assembly for fastening the sheet of material to the boat.

6 Claims, 3 Drawing Sheets

BOAT SEAT COVER

BACKGROUND OF THE INVENTION

1. Field of the Invention

The present invention relates to boat seat covers and more particularly pertains to a new boat seat cover for protecting the boat seat from the outside elements.

2. Description of the Prior Art

The use of boat seat covers is known in the prior art. More specifically, boat seat covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,320,405; U.S. Pat. No. 5,380,059; U.S. Pat. No. des. 367,788; U.S. Pat. No. 5,240,020; U.S. Pat. No. 5,102,190; and U.S. Pat. No. 5,638,849.

While these devices fulfill their respective, particular objectives and requirements, the aforementioned patents do not disclose a new boat seat cover. The inventive device includes a container having a longitudinal opening being disposed through a side wall thereof; and also includes a spring-loaded spindle being rotatably disposed in the container; and further includes a cover member including a sheet of material being carried about and retractably extended from the spring-loaded spindle and also having an outer edge; and also includes a fastening assembly for fastening the sheet of material to the boat.

In these respects, the boat seat cover according to the present invention substantially departs from the conventional concepts and designs of the prior art, and in so doing provides an apparatus primarily developed for the purpose of protecting the boat seat from the outside elements.

SUMMARY OF THE INVENTION

In view of the foregoing disadvantages inherent in the known types of boat seat covers now present in the prior art, the present invention provides a new boat seat cover construction wherein the same can be utilized for protecting the boat seat from the outside elements.

The general purpose of the present invention, which will be described subsequently in greater detail, is to provide a new boat seat cover apparatus and method which has many of the advantages of the boat seat covers mentioned heretofore and many novel features that result in a new boat seat cover which is not anticipated, rendered obvious, suggested, or even implied by any of the prior art boat seat covers, either alone or in any combination thereof.

To attain this, the present invention generally comprises a container having a longitudinal opening being disposed through a side wall thereof; and also includes a spring-loaded spindle being rotatably disposed in the container; and further includes a cover member including a sheet of material being carried about and retractably extended from the spring-loaded spindle and also having an outer edge; and also includes a fastening assembly for fastening the sheet of material to the boat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures., methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new boat seat cover apparatus and method which has many of the advantages of the boat seat covers mentioned heretofore and many novel features that result in a new boat seat cover which is not anticipated, rendered obvious, suggested, or even implied by any of the prior art boat seat covers, either alone or in any combination thereof.

It is another object of the present invention to provide a new boat seat cover which may be easily and efficiently manufactured and marketed.

It is a further object of the present invention to provide a new boat seat cover which is of a durable and reliable construction.

An even further object of the present invention is to provide a new boat seat cover which is susceptible of a low cost of manufacture with regard to both materials and labor, and which accordingly is then susceptible of low prices of sale to the consuming public, thereby making such boat seat cover economically available to the buying public.

Still yet another object of the present invention is to provide a new boat seat cover which provides in the apparatuses and methods of the prior art some of the advantages thereof, while simultaneously overcoming some of the disadvantages normally associated therewith.

Still another object of the present invention is to provide a new boat seat cover for protecting the boat seat from the outside elements.

Yet another object of the present invention is to provide a new boat seat cover which includes a container having a longitudinal opening being disposed through a side wall thereof; and also includes a spring-loaded spindle being rotatably disposed in the container; and further includes a cover member including a sheet of material being carried about and retractably extended from the spring-loaded spindle and also having an outer edge; and also includes a fastening assembly for fastening the sheet of material to the boat.

Still yet another object of the present invention is to provide a new boat seat cover that is easy and convenient to use.

Even still another object of the present invention is to provide a new boat seat cover that be easily removed from over the boat seat and safely stored for later use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
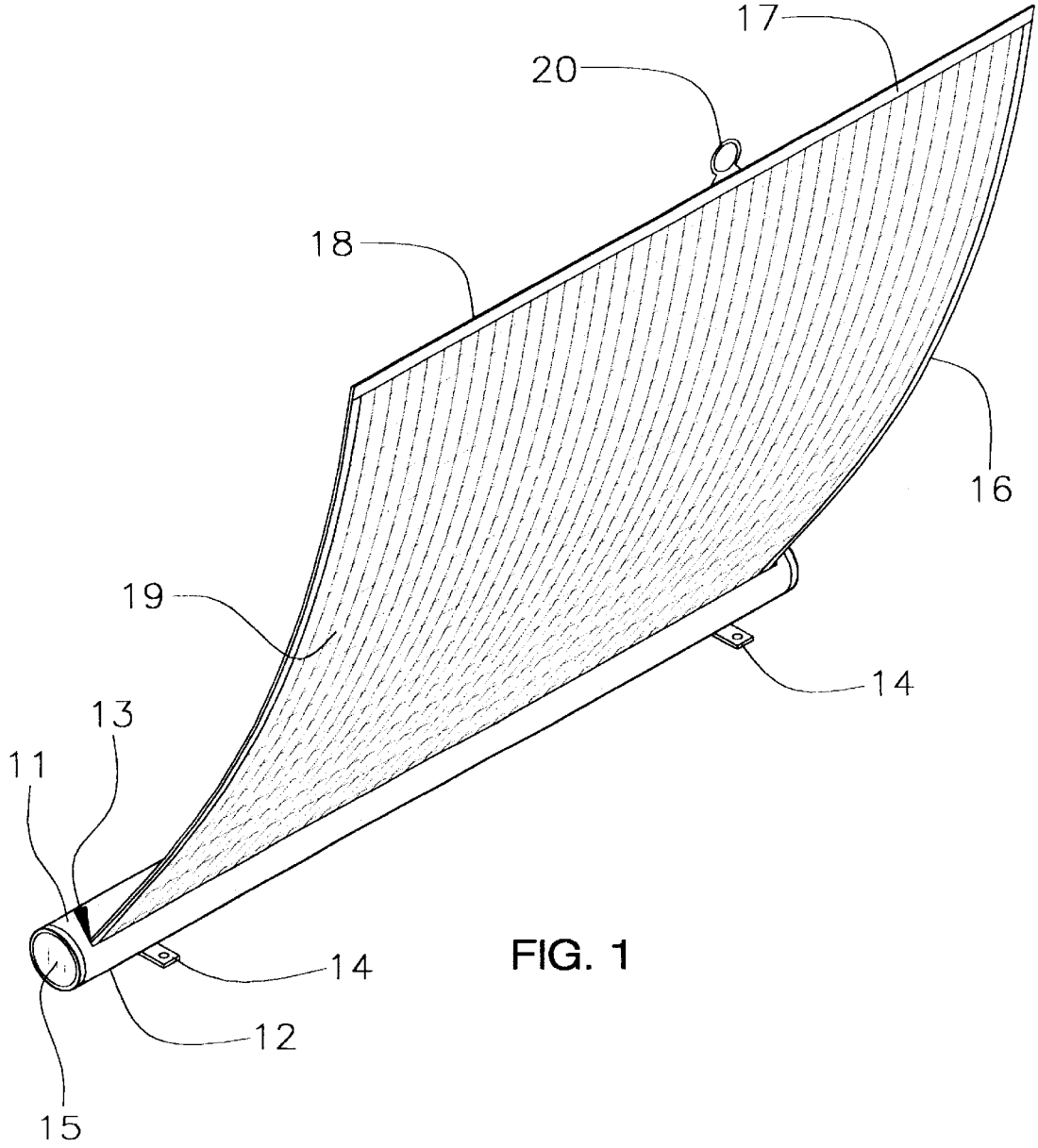
FIG. 1 is a perspective view of a new boat seat cover according to the present invention.
Figure 2:
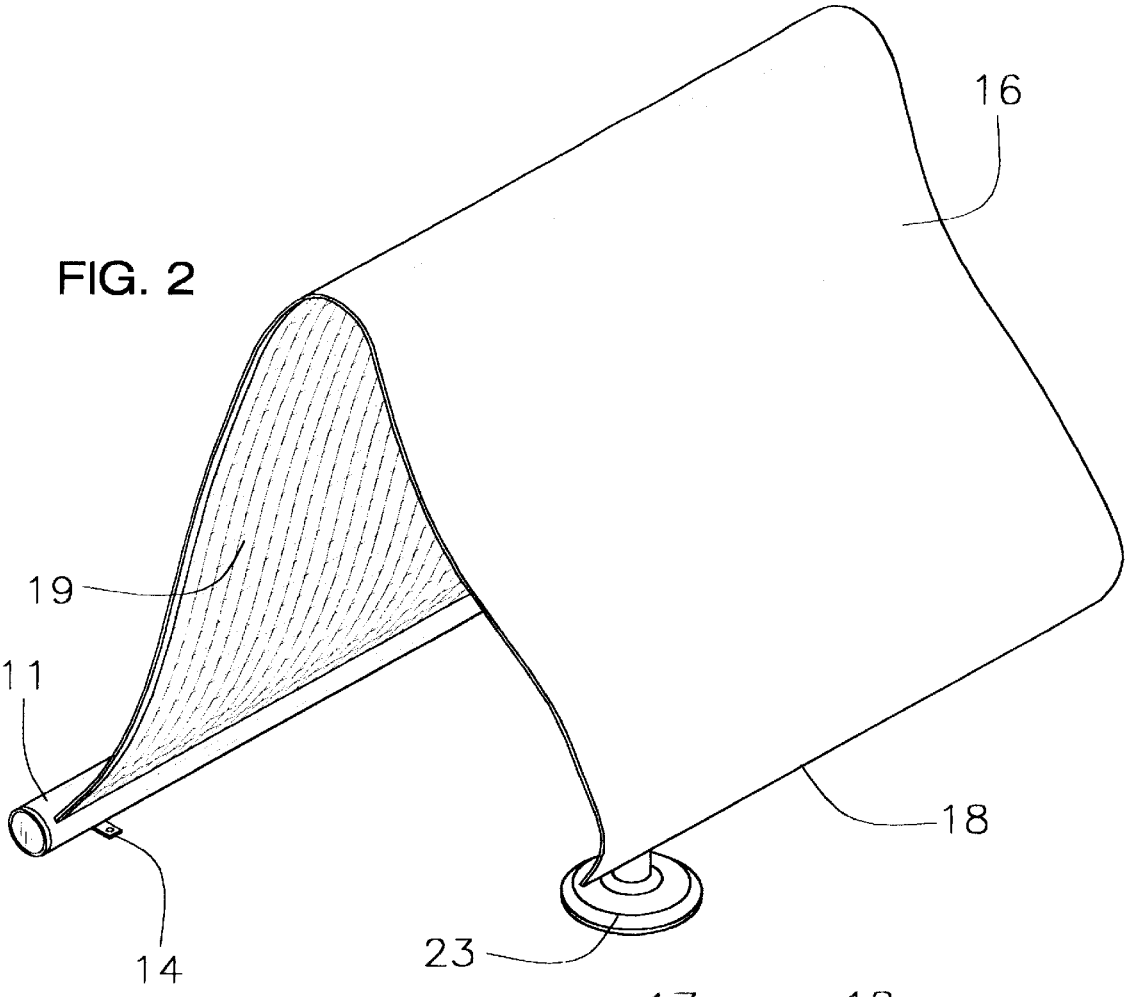
FIG. 2 is another perspective view of the present invention being extended over a boat seat.
Figure 5:
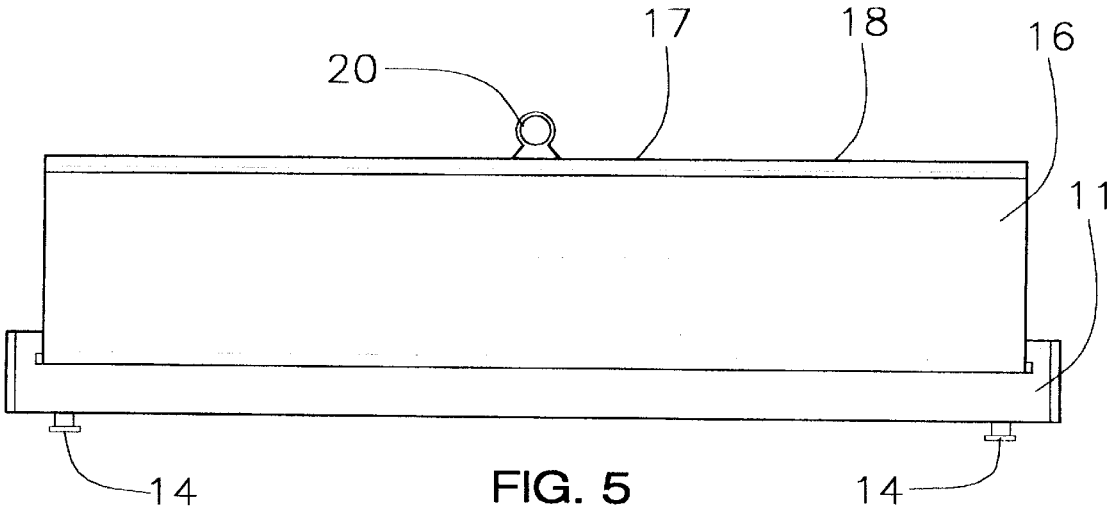
FIG. 5 is a front elevational view of the present invention.
Figure 3:
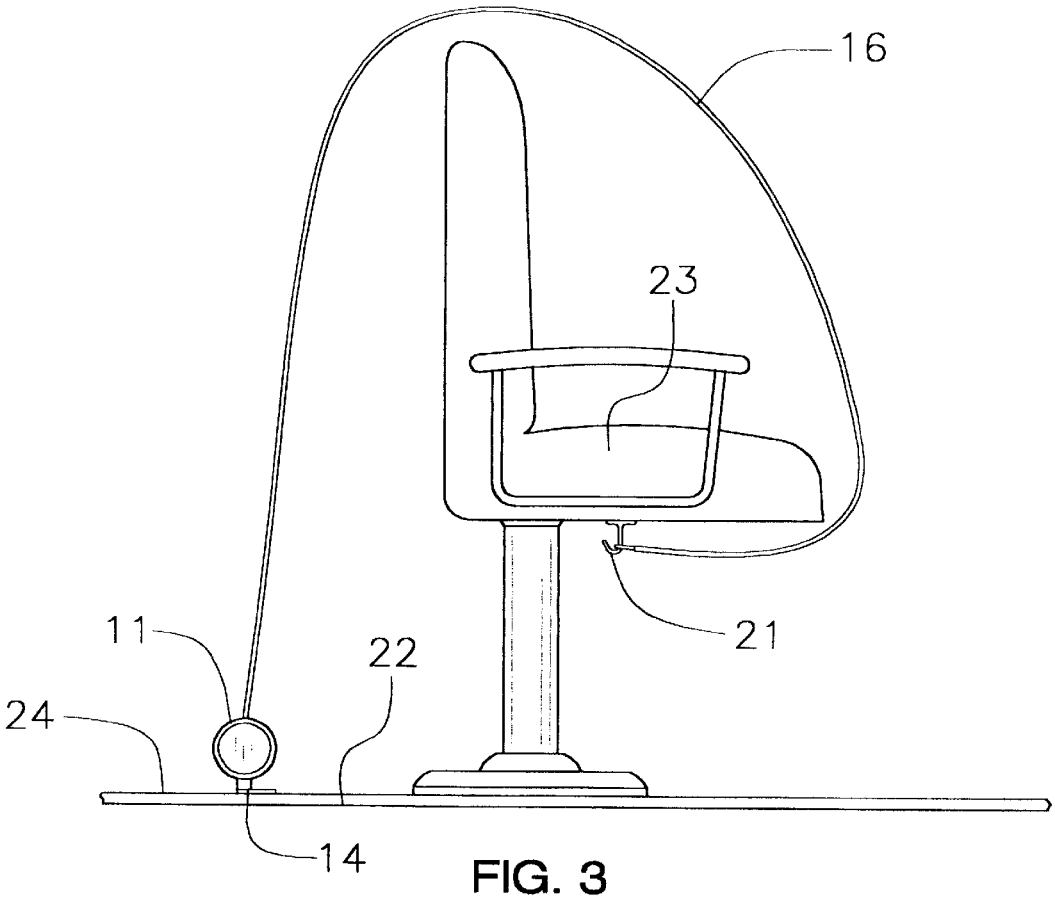
FIG. 3 is a side elevational view of the present invention shown in use.
Figure 4:
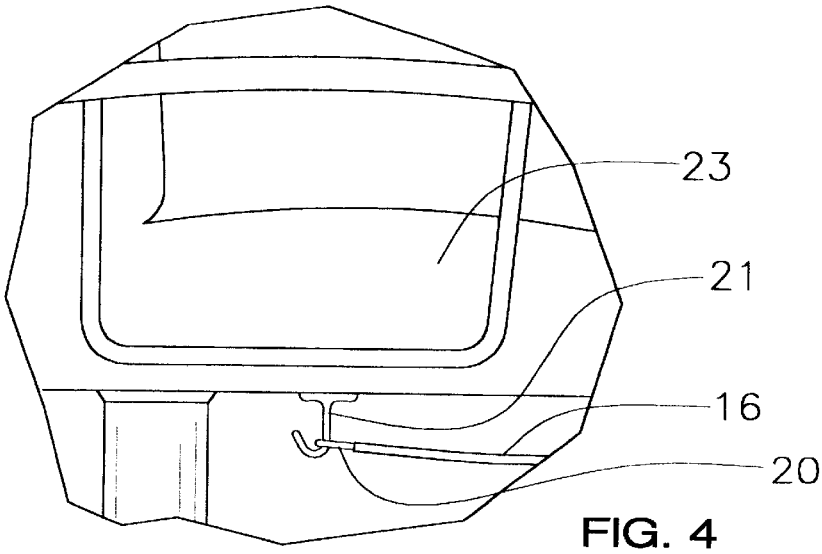
FIG. 4 is a detailed side elevational view of the fastening assembly of the present invention.

With reference now to the drawings, and in particular to FIGS. 1 through 5 thereof, a new boat seat cover embodying the principles and concepts of the present invention and generally designated by the reference numeral 10 will be described.

As best illustrated in FIGS. 1 through 5, the boat seat cover 10 generally comprises a container 11 having a longitudinal opening 13 being disposed through a side wall 12 thereof. The container 11 is an elongate cylinder with the longitudinal opening 13 extending a length thereof. The container 11 is adapted to conventionally fasten with brackets 14 to a floor 23 of the boat 22. A spring-loaded spindle 15 is conventionally and rotatably disposed in the container 11.

A cover member includes a sheet of material 16 being conventionally carried about and retractably extended from the spring-loaded spindle 15 through the longitudinal opening 13 and also having an outer edge 17. The cover member further includes an elongate support member 18 being conventionally attached to the outer edge 17 of the sheet of material 11. The cover member also includes a mesh material 19 being conventionally attached to an underside of the sheet of material 16 for providing strength to the sheet of material 11 with the sheet of material 11 having a length of approximately 4 to 6 feet and a width of approximately 5 feet.

A fastening assembly for fastening the sheet of material 11 to the boat 22 includes at least one first fastening member 20 being conventionally attached to the elongate support member 18, and also includes at least one second fastening member 21 being adapted to be conventionally attached to the boat 22 and being fastenable to the at least one first fastening member 20. The at least one first fastening member 20 is an eyelet, and the at least one second fastening member 21 is a hook member being fastenable to the eyelet.

In use, the user unrolls the sheet of material 16 from the spring-loaded spindle 15 through the longitudinal opening 13 of the container 11, and extends the sheet of material 16 over the boat seat 24 and fastens the sheet of material 16 to the underside of the boat seat 24 using the eyelet 20 and the hook member 21.

It should be realized that the sheet of material may optionally be extended over more than one seat, and relatively wider sheets of material may be provided for such a purpose. This is especially effective when two or more seats are positioned in a relatively close side by side or back to back relationship.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A boat seat cover for covering one or more seats mounted on a boat, said boat seat cover comprising:

a container having a longitudinal opening being disposed through a side wall thereof;

a spring-loaded spindle being rotatably disposed in said container;

a cover member including a sheet of material being carried about and retractably extended from said spring-loaded spindle and also having an outer edge;

a fastening assembly for fastening said sheet of material to the boat; and said cover member including a mesh material being attached to an underside of said sheet of material for providing strength to said sheet of material, said mesh material extending substantially the width and the length of said sheet of material such that said mesh material reinforces said sheet material along the length and width of the material.

2. A boat seat cover as described in claim 1, wherein said container is an elongate cylinder having said longitudinal opening extending a length thereof, said container being adapted to fasten with brackets to a floor of the boat.

3. A boat seat cover as described in claim 1, wherein said cover member further includes an elongate support member being attached to said outer edge of said sheet of material.

4. A boat seat cover as described in claim 3, wherein said fastening assembly includes at least one first fastening member being attached to said elongate support member, and also includes at least one second fastening member being adapted to be attached to the boat and being fastenable to said at least one first fastening member.

5. A boat seat cover as described in claim 4, wherein said at least one first fastening member is an eyelet, and said at least one second fastening member is a hook member being fastenable to said eyelet.

6. A boat seat cover for covering one or more seats mounted on a boat, said boat seat cover comprising:

a container having a longitudinal opening being disposed through a side wall thereof, said container being an elongate cylinder having said longitudinal opening extending a length thereof, said container being adapted to fasten with brackets to a floor of the boat;

a spring-loaded spindle being rotatably disposed in said container;

a cover member including a sheet of material being carried about and retractably extended from said spring-loaded spindle and also having an outer edge, said cover member further including an elongate support member being attached to said outer edge of said sheet of material, said cover member also including a mesh material being attached to an underside of said sheet of material for providing strength to said sheet of material said sheet of material having a length of approximately 4 to 6 feet and a width of approximately 5 feet, said mesh material extending substantially the width and the length of said sheet of material such that said mesh material reinforces said sheet material along the length and width of the material; and a fastening assembly for fastening said sheet of material to the boat, said fastening assembly including at least one first fastening member being attached to said elongate support member and also including at least one second fastening member being adapted to be attached to the boat and being fastenable to said at least one first fastening member, said at least one first fastening member being an eyelet, and said at least one second fastening member being a hook member being fastenable to said eyelet.

* * * * *